US007427925B2

(12) United States Patent
Barrett et al.

(10) Patent No.: US 7,427,925 B2
(45) Date of Patent: Sep. 23, 2008

(54) HAZARD DETECTOR

(75) Inventors: Roger Barrett, Worthing (GB); Jeffrey John Cutler, Cosham (GB)

(73) Assignee: Apollo Fire Detectors Limited, Havant (GB)

( * ) Notice: Subject to any disclaimer, the term of this patent is extended or adjusted under 35 U.S.C. 154(b) by 307 days.

(21) Appl. No.: 10/541,434

(22) PCT Filed: Jan. 5, 2004

(86) PCT No.: PCT/GB2004/000004

§ 371 (c)(1),
(2), (4) Date: Dec. 8, 2005

(87) PCT Pub. No.: WO2004/061793

PCT Pub. Date: Jul. 22, 2004

(65) Prior Publication Data

US 2006/0220891 A1 Oct. 5, 2006

(30) Foreign Application Priority Data

Jan. 3, 2003 (GB) ..... 0300094.0

(51) Int. Cl.
*G08B 17/10* (2006.01)

(52) U.S. Cl. ..... 340/628; 340/539.1; 340/588; 340/825.06; 324/72; 324/11

(58) Field of Classification Search ..... 340/603, 340/539.1, 588, 532, 628–630, 825.06; 324/72, 324/76.11, 11, 76
See application file for complete search history.

(56) References Cited

U.S. PATENT DOCUMENTS 2,843,726 A * 7/1958 Kiernan ..... 219/56.22
3,932,790 A * 1/1976 Muchnick ..... 361/77
4,595,914 A 6/1986 Siegel
4,818,970 A * 4/1989 Natale et al. ..... 340/539.26
5,013,567 A * 5/1991 Govenius ..... 426/314
5,117,219 A * 5/1992 Tice et al. ..... 340/518
5,420,440 A * 5/1995 Ketler et al. ..... 250/573
5,475,363 A * 12/1995 Suzuki et al. ..... 340/506
5,716,725 A * 2/1998 Riveron et al. ..... 429/1

(Continued)

FOREIGN PATENT DOCUMENTS

GB 2137790 A 10/1984

(Continued)

*Primary Examiner*—George A Bugg
*Assistant Examiner*—Daniel Previl
(74) *Attorney, Agent, or Firm*—Cowan, Liebowitz & Latman, P.C.

(57) ABSTRACT

A hazard detector has an electronic circuit with a start-up program for causing emission of a local indicator signal, such as a flashing signal from a LED, if power and ground terminals of the detector are connected with proper orientation, i.e. polarity, to power and ground lines of a power supply. Through this means, a person installing the hazard detector can tell immediately after connection if the detector has been connected with proper orientation, and avoids the need for introducing a hazard such as heat or smoke to test the operation of the detector. A variation uses a more sophisticated program that disables, during a test mode, complex filtering algorithms that are used by detectors to block false alarm signals; if such filtering is not disabled, impedes normal testing of the detectors.

12 Claims, 4 Drawing Sheets

Polarity protection using diode bridge

U.S. PATENT DOCUMENTS 5,751,215 A * 5/1998 Hall, Jr. ..... 340/584
5,966,079 A 10/1999 Tanguay
6,040,769 A * 3/2000 Payne ..... 340/506

FOREIGN PATENT DOCUMENTS

GB 2157871 A 10/1985
GB 2175686 A 12/1986
GB 2298976 A 9/1996
GB 2366191 A 3/2002
JP 5225466 9/1993
WO PCT/AU95/00493 * 2/1996

* cited by examiner

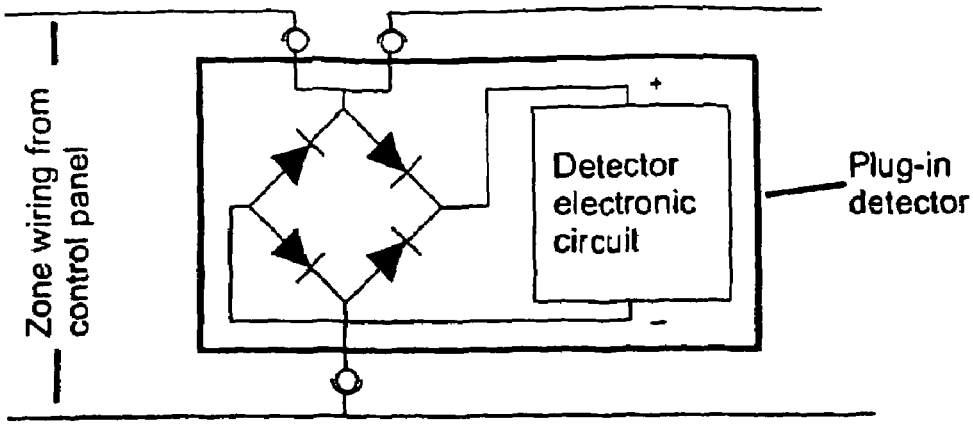
Fig 1 Polarity protection using diode bridge
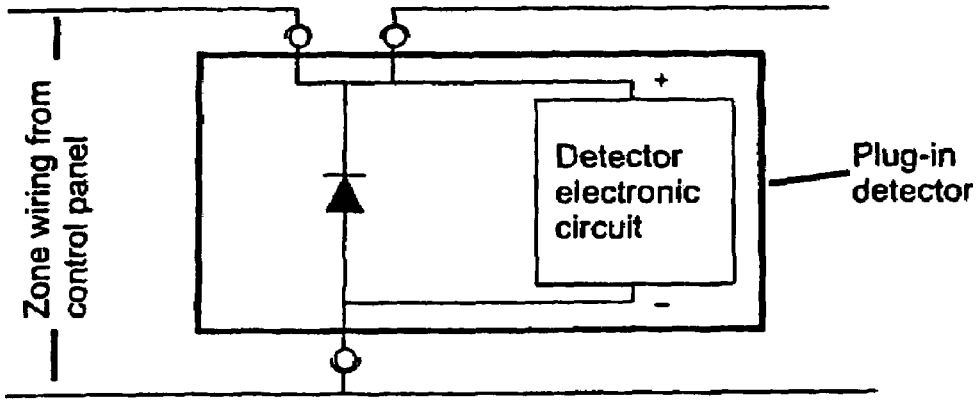
Fig 2 Polarity protection using shunt diode
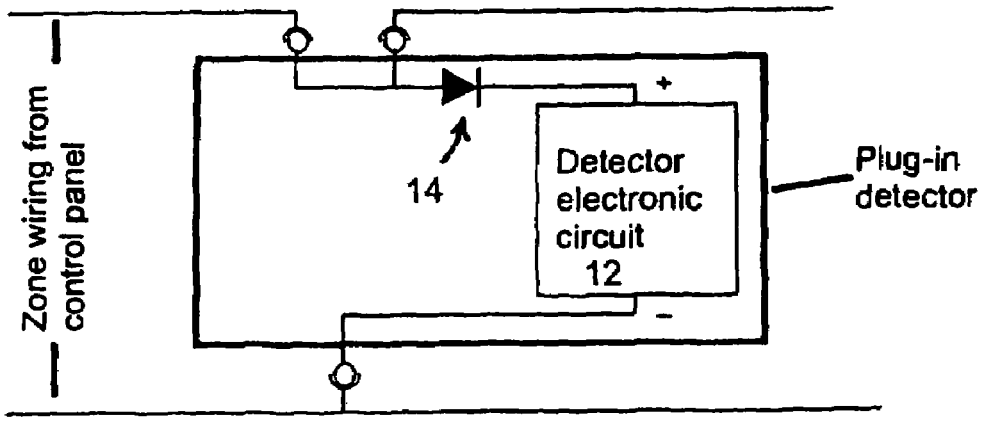
Fig 3 Polarity protection using series diode

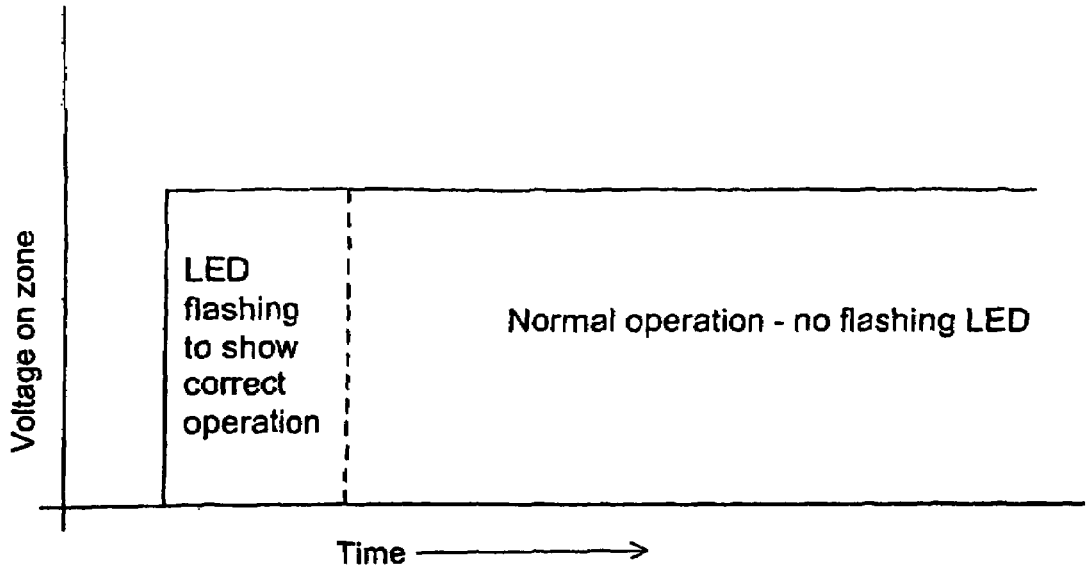
Fig 4 Flashing LED on power-up
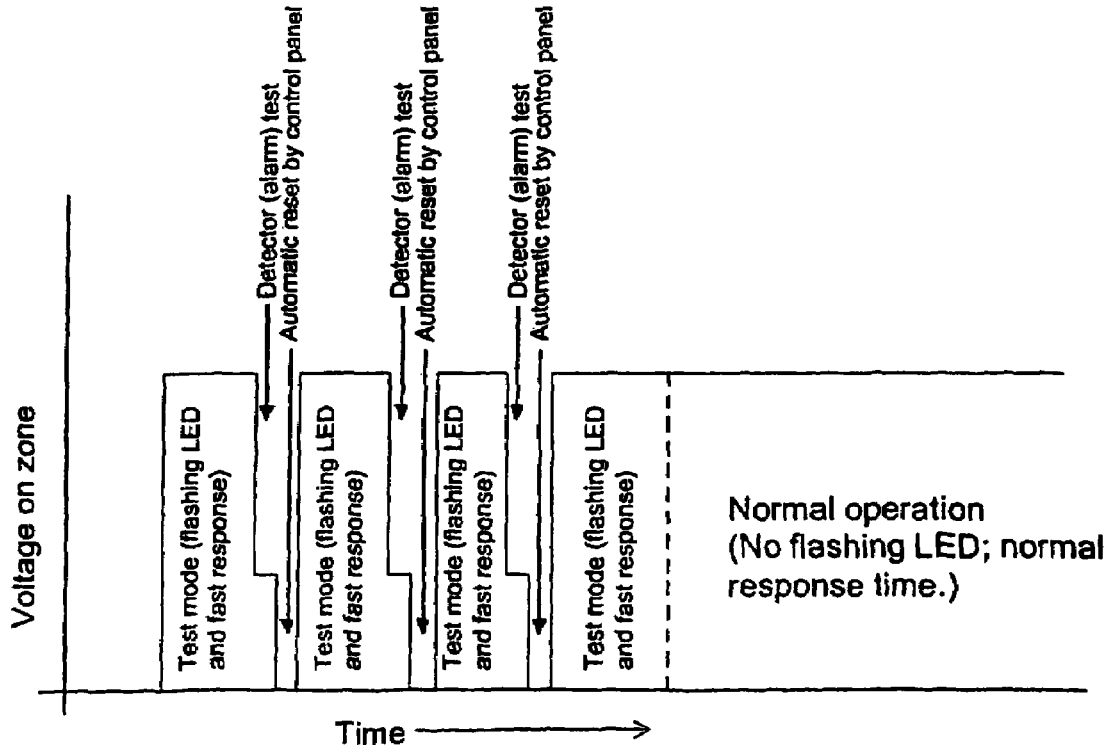
Fig 5 Special test mode on power-up Flowchart of smoke detector operation from cold start or reset Flowchart of heat detector operation from cold start or reset

HAZARD DETECTOR

BACKGROUND OF THE INVENTION

The present invention relates to a hazard detector, and more particularly, in one form to a fire-hazard detector that includes protection against incorrect installation, and/or for which in-situ testing is facilitated. In another form, the invention is applicable to a hazard detector the operation of which can be modified when it is in a test mode. The invention is applicable to detectors sensitive to other hazards, e.g. (without limitation) toxic gas, radiation or intruders. The term 'hazard detector' thus is to be construed accordingly.

Conventional fire detectors are normally used in simple two-wire circuits powered by a battery or other secure DC supply. When in a stand-by mode, such detectors present a high resistance between the two circuit wires and draw a negligible current from the battery, whereas in an alarm mode they introduce a low resistance across the two circuit wires. The high resistance presented during the stand-by mode normally makes it impossible during that mode to monitor the presence of such a detector on a two-wire circuit. Therefore, to ensure that such fire detectors will operate properly in the alarm mode, it becomes important to determine that they are correctly connected., and regular testing is required.

Some detectors are made insensitive to the polarity of the power supply so as to simplify their installation and avoid problems that occur when a polarity-sensitive device is installed improperly. One way to make a detector insensitive to power-supply polarity is to introduce a diode bridge; this is illustrated in FIG. 1. The drawback with this arrangement is two-fold; it adds cost, and it increases the minimum operating voltage of the detector significantly due to the voltage drop across the diode bridge.

If a diode bridge or another circuit is not introduced to make the detector insensitive to power-supply polarity, then it becomes necessary to protect the electronic circuit in the detector against a reverse-polarity connection in some other way. This is normally achieved by adding to the detector a diode in parallel with the electronic circuit of the detector and in reverse polarity across the power supply when the detector is properly connected; this is illustrated in FIG. 2. If the detector happens to be connected in a reverse fashion across the power supply, the diode will also be connected in the wrong direction, which will result in a short-circuit being presented to the control panel, indicating a wiring fault. While this arrangement may be acceptable for many control panels, there are some panels in which a momentary reversal of the power supply is used as part of a line-monitoring system; in such control panels, a short-circuit caused by polarity reversal is not acceptable.

An alternative method of protecting the electronic circuit of a detector against reverse polarity is the inclusion in the detector of a blocking diode in series with the other electronic circuitry of the detector; one embodiment of this is illustrated in FIG. 3. This method will operate on all known systems. However, it has the disadvantage that an inadvertent reverse connection will not result in a fault condition being shown at the control panel. To verify correct connection it is necessary to initiate an alarm condition in the detector, either by using smoke or other appropriate stimulus or by using a special test facility. This is inconvenient in that the alarm condition will be registered by the control panel, which may cause an audible alarm to sound or other action to be taken (such as an automatic call to a fire department).

SUMMARY OF THE INVENTION

It is an object of at least the preferred embodiments of the invention to provide a detector in which at least some of the foregoing disadvantages are alleviated.

In one aspect the invention provides a hazard detector comprising means for detecting a hazardous condition and for indicating an alarm upon such detection, and means for modifying the behaviour of the detector during a start-up or test mode to facilitate commissioning or testing of the detector. The hazardous condition may be a hazardous smoke level, or may be a hazardous rate of temperature rise. The hazardous rate of temperature rise may be a rate of temperature rise that is equal to, or exceeds, approximately five degrees over a period of thirty seconds.

The modifying means may be a means for filtering out transient detections of the hazardous condition during a normal state of operation and means for disabling the filtering means during the start-up or test mode. The filtering-out of transients can reduce the number of false alarms.

Preferably, the detector is for connection between positive and negative power lines, the detector having a positive terminal and a negative terminal and being adapted, upon application of power to the power lines, to emit a local indicator signal if the positive and negative terminals of the detector have a correct polarity orientation to the positive and negative lines.

In another aspect the invention is a hazard detector for connection between positive and negative power lines, the detector having a positive terminal and a negative terminal and being adapted, immediately following application of power to the power lines, to emit a local indicator signal if the positive and negative terminals of the detector have a correct polarity orientation to the positive and negative lines.

Preferably, the detector includes an electronic circuit serially-connected to a blocking diode, the blocking diode being connected to either the positive or negative terminal. Preferably, the indicator signal is a light signal. More preferably, the indicator signal is a flashing light signal with repetitive on/off cycle, the period of which may be approximately one second.

The flashing light signal may be produced by a light-emitting diode (LED) that forms part of the electronic circuit. Preferably, the LED emits red light.

Preferably, the detector is in a test mode when it is emitting the local indicator signal.

BRIEF DESCRIPTION OF THE DRAWINGS

Preferred features of the present invention will now be described, by way of example only, with reference to the accompanying drawings, in which:—

FIG. 1 is a schematic illustration of a hazard detector that uses a diode bridge for polarity protection;

FIG. 2 is a schematic illustration of a hazard detector that uses a shunt diode for polarity protection;

FIG. 3 is a schematic illustration of a hazard detector that uses a series diode for polarity protection;

FIG. 4 illustrates a sequence of output operations of a hazard detector in a first embodiment of the subject invention;

FIG. 5 illustrates a sequence of output operations of a hazard detector in a second embodiment of the subject invention;

DETAILED DESCRIPTION OF PREFERRED EMBODIMENTS

The subject invention involves a hazard detector of the type which uses a series diode for polarity protection, as previously discussed with respect to FIG. 3. However, the two embodiments that are described additionally include a light-emitting diode (LED) as well as a suitably-programmed ROM or EPROM to cause the LED to perform in a manner to be described.

In the first embodiment, when a hazard detector 10 of the subject invention is initially connected to a power supply, current only flows through a detector electronic circuit 12 (see FIG. 3) if the detector 10 is connected to the power supply in a proper orientation (polarity); if the detector 10 is connected with reverse orientation, a series diode 14 prevents current from flowing through circuit 12. The series diode 14 is shown connected to the positive terminal of circuit 12, but it could instead be connected to the negative terminal. If the detector 10 is connected with proper orientation, the circuit 12 becomes powered-up (a "cold start" not involving additional external circuitry), and an internal program in a ROM or EPROM (not shown) of circuit 12 automatically begins execution of a start-up program. The start-up program causes a LED (not shown) connected to circuit 12 to flash on/off for about four minutes at a rate of approximately once per second. Both the rate and length of the flashing are adjustable and controlled by a processor or by a separate timing subcircuit of circuit 12. A person connecting the detector of the invention to the power supply is immediately able to tell, by observing if the LED is flashing, whether the detector is connected with proper orientation. The LED operation following proper connection is illustrated in FIG. 4.

After correct installation, the flashing ability of the detector may be utilized in a further way, namely, to assist with locating a power-supply wiring fault. If an open-circuit fault occurs at an unknown location on the power-supply wiring, the power supply is temporarily disconnected. After reconnection, only those detectors that are located between a control panel and the fault location will begin to flash. The location of the fault can thereby be detected without requiring any of the detectors to be removed or any special test meter to be connected; in effect, the detectors act together as a test meter.

Figure 6:
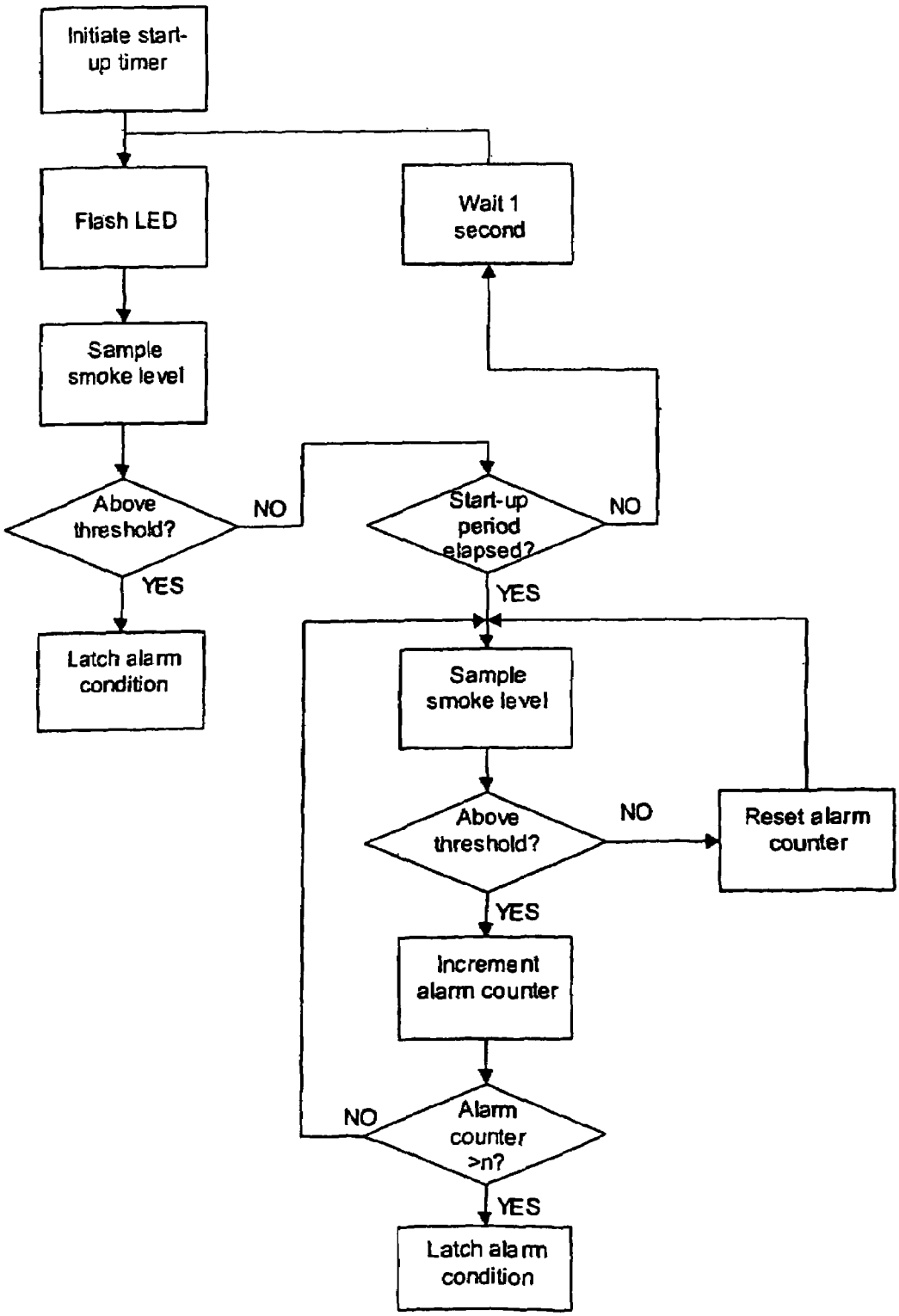
FIG. 6 is a flowchart of the operation of the hazard detector in a first form of the second embodiment, the first form being a smoke detector that measures smoke level; and, FIG. 7 is a flowchart of the operation of the hazard detector in a second form of the second embodiment, the second form being a heat detector that measures a rate of temperature rise.
Figure 7:
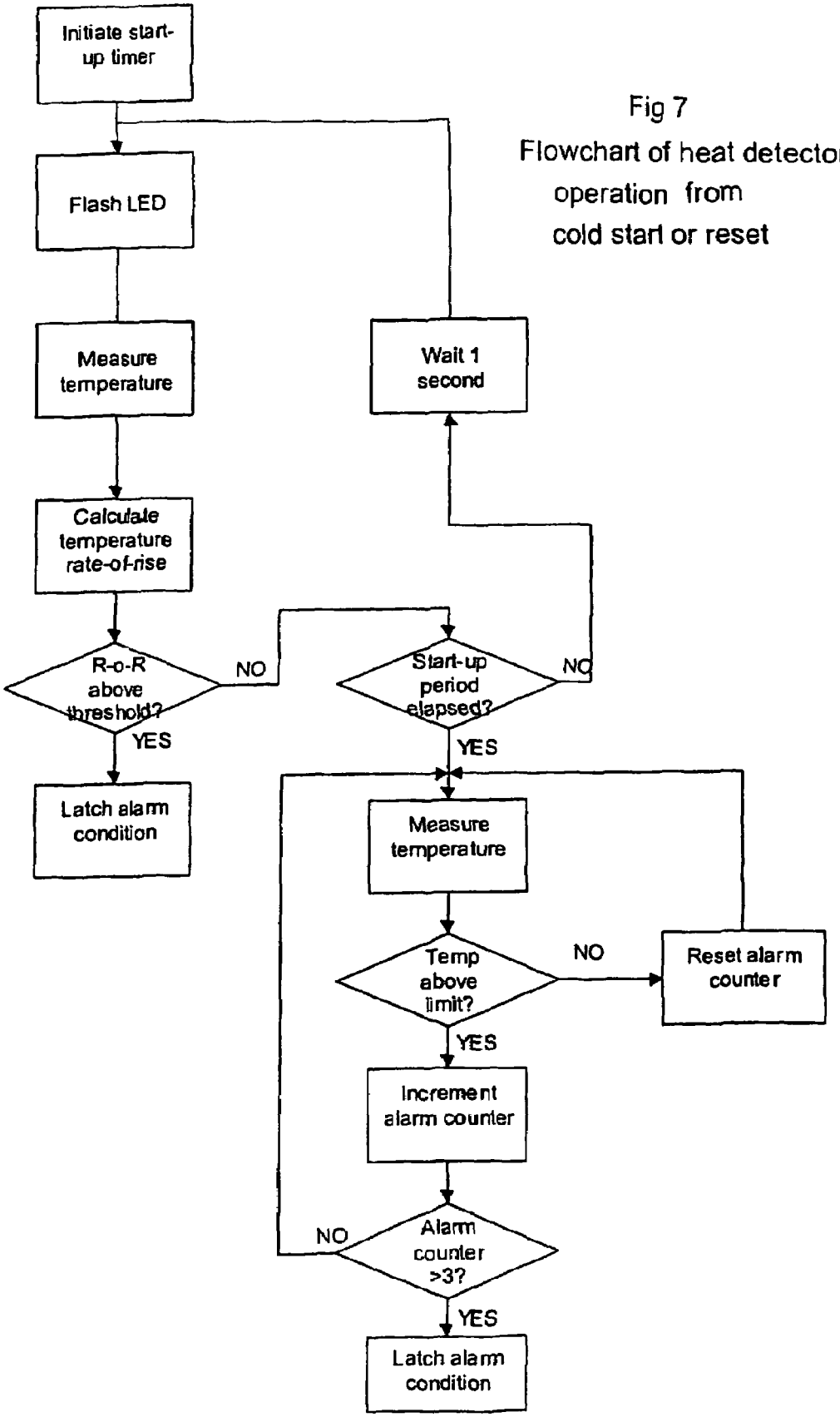

A second embodiment, illustrated in FIGS. 5, 6 and 7, facilitates in-situ testing by removing transient filtering of input signals during a test mode. FIG. 6 indicates a situation where a hazardous condition being measured relates to smoke level, and FIG. 7 indicates a situation where a hazardous condition being measured relates to a rate of rise in temperature. In order to reduce the cost and inconvenience of false alarms, there has developed a trend towards more complex signal processing of the signals input to hazard detectors. One known technique is to include signal filtering to reject transient signals. An unfortunate side effect of such filtering is that it tends to cause a rejection of signals produced by normal testing tools, making in-situ testing of detectors very difficult.

The second embodiment includes the flashing LED test program for polarity orientation of the first embodiment, but adds an additional program to address the problem caused by the presence of the complex signal processing mentioned above. The additional program disables or bypasses those parts of operating algorithms that function as the filters for reducing false alarms; the basic sensitivity of the detector is not affected by such disabling of the filter. The test mode in the second embodiment is initiated by disconnecting the detector from the power supply. This can be performed from the control panel for all detectors of the system by using the panel Is reset facility, or alternatively, each detector can be briefly individually disconnected from, and reconnected to, the power supply.

Most use for the test mode of the second embodiment would come with control panels that include what is termed in the field a special "walk test" mode. When set to the "walk test" mode, the controller allows an engineer to trigger an alarm on a detector by, for example, using artificial smoke or a rapid rise in temperature, and to then see from the permanently-lit alarm LED that the control panel has accepted the alarm. After the alarm has been activated, the control panel automatically resets the detector by briefly interrupting the power supply to the zone in which the alarm is situated. Each reset process simultaneously performs a cold start on all of the detectors in the zone, thereby maintaining them in the test state. At the completion of testing, the control panel is returned to normal operation and after completing its start-up program, the internal processor in each detector operates that detector in its normal monitoring state, i.e. the LED no longer flashes, the transient filtering has been enabled, and the detector is alert to its selected hazard.

It will be appreciated that if preferred the detector can incorporate the filtering-disablement feature without the flashing LED. For example, the filtering could be disabled by a switch manually operated by a maintenance technician when in-situ testing is required.

Although it is known for some conventional detectors to utilize a LED on a flash cycle, those LEDs operate continuously as long as the power supply is connected; they are not used, as in the subject invention, to indicate that a detector has been connected with proper orientation to a power supply. At least in Germany, the type of detector LED that continues to display a flashing signal as long as power is connected must not be coloured red. However, use of red-coloured LEDs are allowed if their flashing corresponds to a "special mode of operation"; the temporary flashing during the start-up of the detector of this invention qualifies as such a special mode.

The detection of rate of rise of temperature, as illustrated in FIG. 7, is an advance on the detection of a pre-set limit for temperature (,fixed temperature, detection). Measurement of the rate of rise of temperature may result in an alarm being signalled before a pre-set temperature has been reached, thus providing an earlier warning of a serious fire condition than fixed temperature detection. Fixed-temperature detectors are used in environments in which in which rapid changes in temperature are normal. Such applications include kitchens and boiler rooms. Fixed-temperature detectors often have pre-set alarm temperatures of 100° C. or more. Such detectors can be very difficult to test because their sensing elements must be heated to above their alarm temperature before any response occurs. The energy input required for such testing is difficult to achieve with a portable in-situ tester.

In the arrangement illustrated in FIG. 7 the detector runs a special test algorithm during the start-up period. This algorithm causes the detector to signal an alarm if an abnormal rate of temperature rise is sensed, regardless of the absolute temperature. For example, a rate of temperature rise that is equal to, or exceeds, approximately 5 degrees Centigrade over a period of 30 seconds might be used. Such a rate of temperature rise is unlikely to be caused by normal ambient variations occurring during the start-up period but can safely be used as an indication that the detector is operating correctly.

While the present invention has been described in its preferred embodiments, it is to be understood that the words which have been used are words of description rather than limitation, and that changes may be made to the invention without departing from its scope as defined by the appended claims.

Each feature disclosed in this specification (which term includes the claims) and/or shown in the drawings may be incorporated in the invention independently of other disclosed and/or illustrated features.

The text of the abstract filed herewith is repeated here as part of the specification.

A hazard detector has an electronic circuit with a start-up program for causing emission of a local indicator signal, such as a flashing signal from a LED, if power and ground terminals of the detector are connected with proper orientation, i.e. polarity, to power and ground lines of a power supply. Through this means, a person installing the hazard detector can tell immediately after connection if the detector has been connected with proper orientation, and avoids the need for introducing a hazard such as heat or smoke to test the operation of the detector. A variation uses a more sophisticated program that disables, during a test mode, complex filtering algorithms that are used by detectors to block false alarm signals; if such filtering is not disabled, it impedes normal testing of the detectors.

The invention claimed is:

1. A hazard detector comprising a circuit for detecting a hazardous condition and for indicating an alarm upon such detection, a filter for filtering out transient detections of the hazardous condition during a normal state of operation of the hazard detector, and a controller for selectively disabling the filter during a start-up of test-mode of the hazard detector to facilitate commissioning or testing of the hazard detector.

2. The detector of claim 1, wherein the hazardous condition is a hazardous smoke level.

3. The detector of claim 1, wherein the hazardous condition is a hazardous rate of rise in temperature.

4. The detector of claim 3, wherein the hazardous rate of rise in temperature is a rate of temperature rise that is equal to, or exceeds, approximately five degrees over a period of thirty seconds.

5. The detector of claim 1, being for connection between positive and negative power lines, the detector having a positive terminal and a negative terminal and being adapted, upon application of power to the power lines, to emit a local indicator signal if the positive and negative terminals of the detector have a correct polarity orientation to the positive and negative lines.

6. The detector of claim 5, comprising an electronic circuit serially-connected to a blocking diode, the blocking diode being connected to either the positive or negative terminal.

7. The detector of claim 5, wherein the indicator signal is a light signal.

8. The detector of claim 7, wherein the indicator signal is a flashing light signal with repetitive on/off cycle.

9. The detector of claim 8, wherein the period of the on/off cycle is approximately one second.

10. The detector of claim 8, wherein the flashing light signal is produced by a light-emitting diode (LED) that forms part of the electronic circuit.

11. The detector of claim 10, wherein the LED is red-coloured.

12. The detector of claim 5, wherein the detector is in a test mode when it is emitting the local indicator signal.

* * * * *